US006929146B1

(12) United States Patent
Galbreath et al.

(10) Patent No.: US 6,929,146 B1
(45) Date of Patent: Aug. 16, 2005

(54) WASTE CONTAINER WITH ACCESS DOOR AND HINGE THEREFOR

(76) Inventors: Donald E. Galbreath, 500 S. Monticello, Winamac, IN (US) 46996; Randy Sommers, 8131 S. 1000 W., Kewanna, IN (US) 46939

( * ) Notice: Subject to any disclaimer, the term of this patent is extended or adjusted under 35 U.S.C. 154(b) by 0 days.

(21) Appl. No.: 10/155,773

(22) Filed: May 26, 2002

(51) Int. Cl.[7] ..... B65D 43/14
(52) U.S. Cl. ..... 220/833; 220/908
(58) Field of Search ..... 220/908, 817–819, 220/833, 286, 248, 324; 16/274, 252, 294, 16/302, 366, 375

(56) References Cited

U.S. PATENT DOCUMENTS

| | | | | |
|---|---|---|---|---|
| 1,059,221 | A * | 4/1913 | Saylor | 220/521 |
| 1,483,624 | A * | 2/1924 | Walker | 217/57 |
| 2,433,305 | A * | 12/1947 | Talcott, Jr. | 16/371 |
| 2,529,478 | A * | 11/1950 | Bach | 220/263 |
| 3,989,162 | A * | 11/1976 | Hodge et al. | 220/817 |
| 4,014,457 | A * | 3/1977 | Hodge | 220/812 |
| 4,098,429 | A * | 7/1978 | Hodge | 220/817 |
| 4,426,020 | A | 1/1984 | Presseau et al. | |
| 4,545,523 | A | 10/1985 | Galbreath et al. | |
| 4,741,455 | A * | 5/1988 | Robbins | 220/817 |
| 5,078,159 | A * | 1/1992 | Yuhara | 132/295 |
| 5,085,341 | A * | 2/1992 | Hodge | 220/811 |
| 5,105,967 | A * | 4/1992 | Horpestad | 220/817 |
| 5,639,129 | A | 6/1997 | Lindley | |
| 6,109,469 | A | 8/2000 | Clive-Smith | |
| 6,296,162 | B1 | 10/2001 | Englander et al. | |
| 6,364,153 | B1 | 4/2002 | Petzitillo, Jr. et al. | |
| 6,364,154 | B2 | 4/2002 | Kruzick et al. | |

* cited by examiner

*Primary Examiner*—Lien M. Ngo
(74) *Attorney, Agent, or Firm*—Woodard, Emhardt, Moriarty, McNett & Henry LLP

(57) ABSTRACT

A waste container includes a container body defining at least one opening; a door sized and configured to close off the at least one opening; a seal connected with one of the container body and the door; a hinge assembly connected between the container body and the door to permit the door to swing between a closed position covering the opening and an open position uncovering the opening, the hinge assembly including at least one hinge unit and at least one control mechanism, the at least one hinge unit having at least first and second door rotation axes and the hinge assembly including a control mechanism mechanically connected between the container body and the door to control the degree of rotation of the door about the at least first and second door rotation axes; wherein the seal is juxtaposed relative to the container body and the door to provide a fluid tight seal between the container body and the door when the door is in a closed and sealed position; and, a latching assembly mechanically connected between the container body and the door to hold the door in the closed and sealed position.

13 Claims, 11 Drawing Sheets

WASTE CONTAINER WITH ACCESS DOOR AND HINGE THEREFOR

FIELD OF THE INVENTION

The present invention relates to waste and/or bulk containers, and more particularly to a waste and/or bulk container with an access door and a combination hinge therefore.

BACKGROUND OF THE INVENTION

Large containers are provided for receiving, transporting, unloading and/or dumping bulk materials such as waste, chemicals, construction materials and the like in packaged or unpackaged form. In the waste hauling industry, for example, such containers are provided with access openings to permit the addition of solid and/or liquid waste, the entry of persons or vehicles into the containers, and the unloading, dumping or ejection of the waste or other materials held therein. It is desired that doors covering such openings be tightly sealable against the container opening periphery to contain any leaking liquid component of the materials.

While numerous configurations have been designed, leakage, premature failure, high cost and inconvenience of use issues remain a concern, and an improved design is desired.

DESCRIPTION OF THE PREFERRED EMBODIMENT

Figure 1:
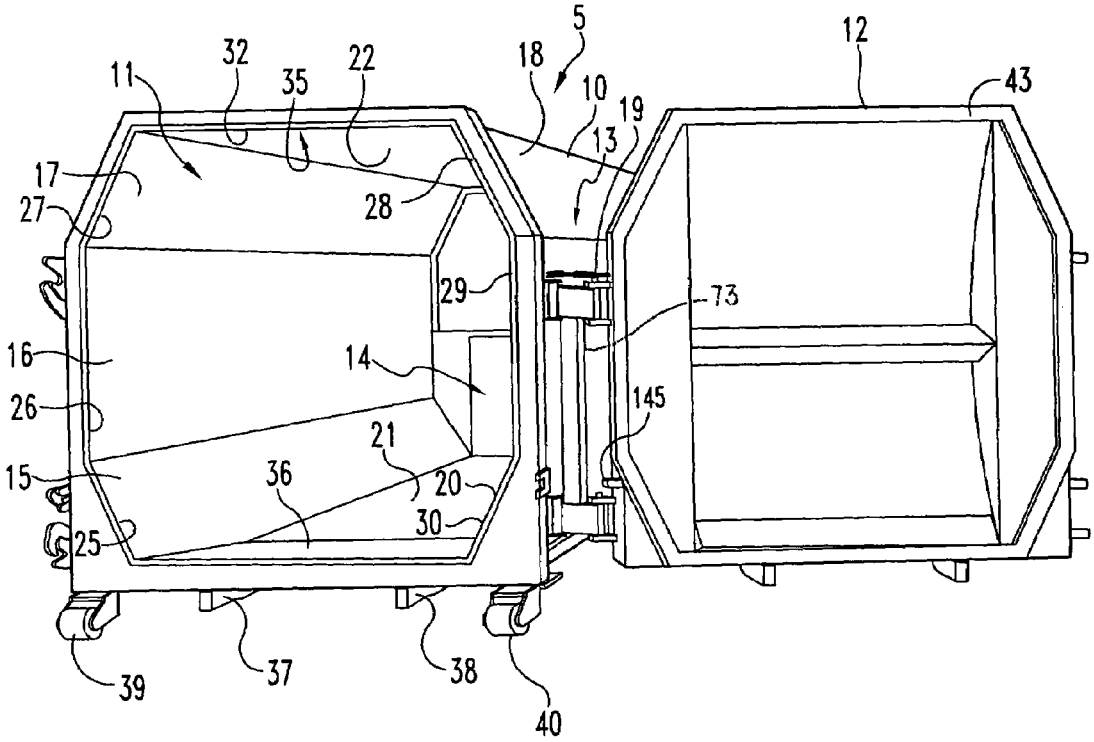
FIG. 1 is a rear, perspective view of a container 5 with a hinge assembly 13 in accordance with the present invention and showing the door 12 of container 5 swung open approximately 180 degrees.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations or modifications in the illustrated device, and any further applications of the principles of the invention as illustrated therein are contemplated as would normally occur to one skilled in the art to which the invention relates.

Referring to FIGS. 1–4, there is shown a waste container 5 that includes a container body 10 with a rear opening 11 and a dump door 12 hingedly mounted thereat by a hinge assembly 13 to close off rear opening 11. Container body 10 also includes a forward access opening 14 through which may be deposited waste in solid and/or liquid form. Container 5 is described herein as a waste container adapted for the receipt, storage, transport, unloading and/or dumping of waste materials. It is also contemplated that container 5 could be adapted for use with other items such as bulk landscaping materials, steel or plastic drums, bags or boxes of materials—essentially anything that is desired to be transported and/or stored in a container having a door that is desired to be tightly sealed to prevent the escape of liquid.

The interior of container body 5 is generally octagonal in cross-section and has side walls 15–20, floor 21 and top wall 22. While the container body 5 of the embodiment described herein is octagonal, container body 5 may have substantially any reasonable cross-sectional shape (e.g. rectangular, pentagonal, etc.). Fixedly connected to the rearmost edges of side walls 15–20, floor 21 and top wall 22 are metal rods 25–32, respectively, which together form a continuous sealing bead 35 that surrounds and defines rear opening 11. Floor 21 is inclined slightly at its rearmost portion to form a ramp 36. Other embodiments are contemplated where the container body 10 has no ramp 36. A pair of longsills 37 and 38 extend downwardly from the bottom of container body 10, and wheels 39 and 40 are connected at the rear of container body 5.

Door 12 is sized and shaped to mate with and sealingly close off the octagonal opening 11. Door 12 includes C-shaped sealing channel 43, which holds along its length a gasket 44. Sealing channel 43 extends in a continuous octagonal run, substantially as shown in FIG. 1, to correspondingly mate with the continuous sealing bead 35 so that, when door 12 is closed and pulled against the rear end of container body 5, sealing bead 35 bears against and forms a fluid tight seal against gasket 44.

Other sealing assemblies are contemplated besides that of bead 35, channel 43 and gasket 44. Such assemblies would include the bead being formed on door 12 and the gasket 44 being connected with container body 10. Such assemblies would also include any alternative structure, either individually or in combination, for bead 35, channel 43 and gasket 44 that will form a fluid tight seal in association with the closing of door 12.

Hinge assembly 13 includes upper and lower hinges 46 and 47 and a control mechanism 48. Hinge assembly 13 can comprise just a single hinge unit or it can comprise multiple hinge units, such as hinges 46 and 47. Hinges 46 and 47 are or can be identical, and only hinge 46 will be described herein for brevity, it being understood to apply equally to the hinge 47 except where indicated. Hinge 46 includes a first pair of mounting brackets 51 and 52, a second pair mounting bracket 53 and 54, a hinge plate 55, and first and second hinge pins 56 and 57. A first backing plate 60 is fixed to the side edge 61 of door 12, and first mounting brackets 51 and 52 are fixed to plate 60 by appropriate means such as welding. A second backing plate 62 is fixed to the side wall 19, and second mounting brackets 53 and 54 are fixed to plate 62 by appropriate means such as welding. Backing plates 60 and 62 both strengthen the connection of hinge 46 to door 12 and side wall 19 and facilitate construction and assembly by allowing hinge 46 to be manufactured separately and then applied as a unit to door 12 and side wall 19.

Figure 2A:
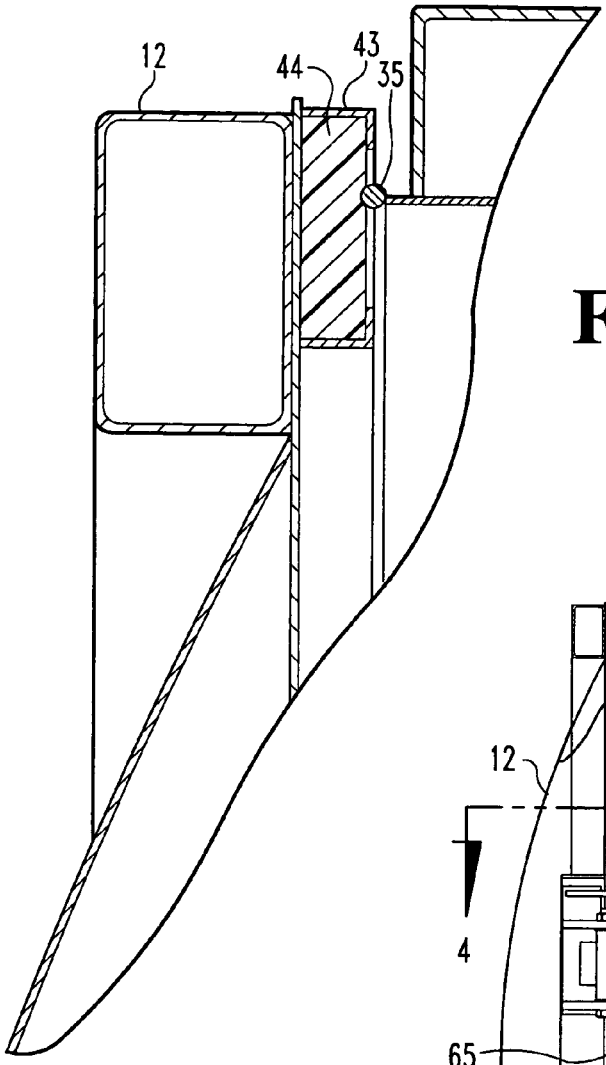
FIG. 2*a* is an enlarged side, cross sectional view of the upper portion of the container body 10 and door 12 of FIG. 2.
Figure 2:
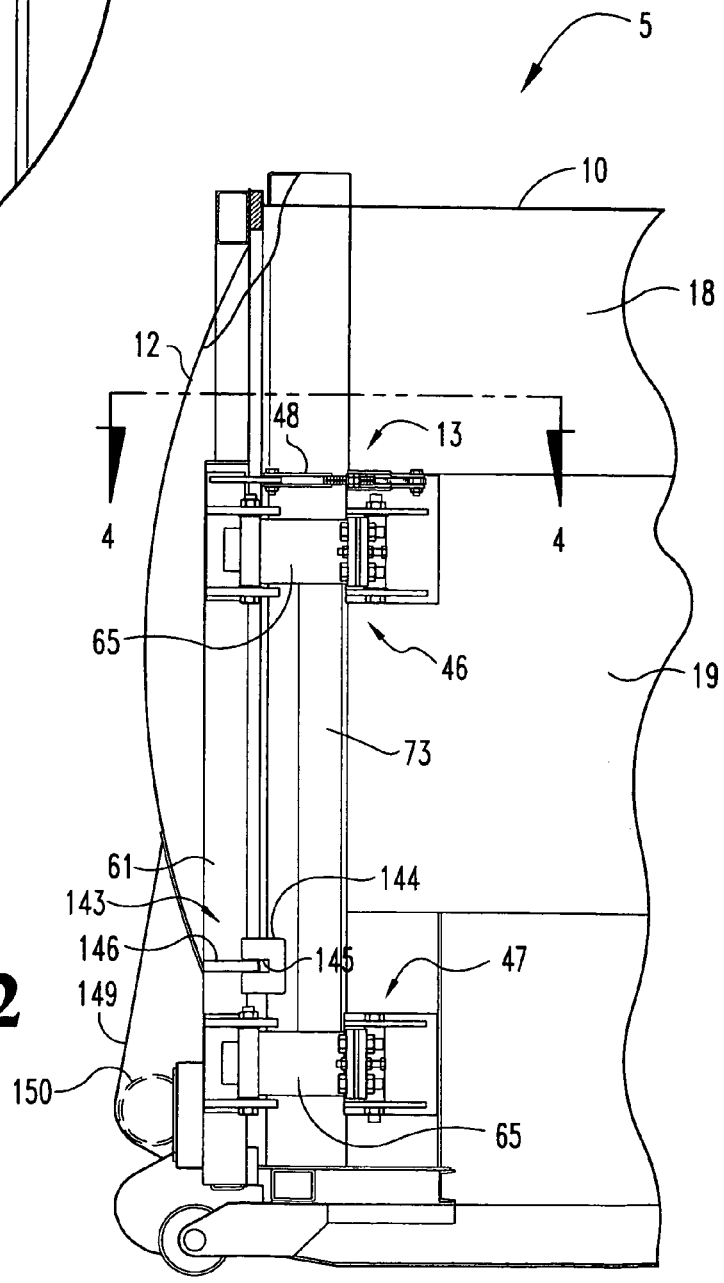
FIG. 2 is a side, elevational view of the container 5 of FIG. 1, and showing door 12 in the closed and sealed position.
Figure 3:
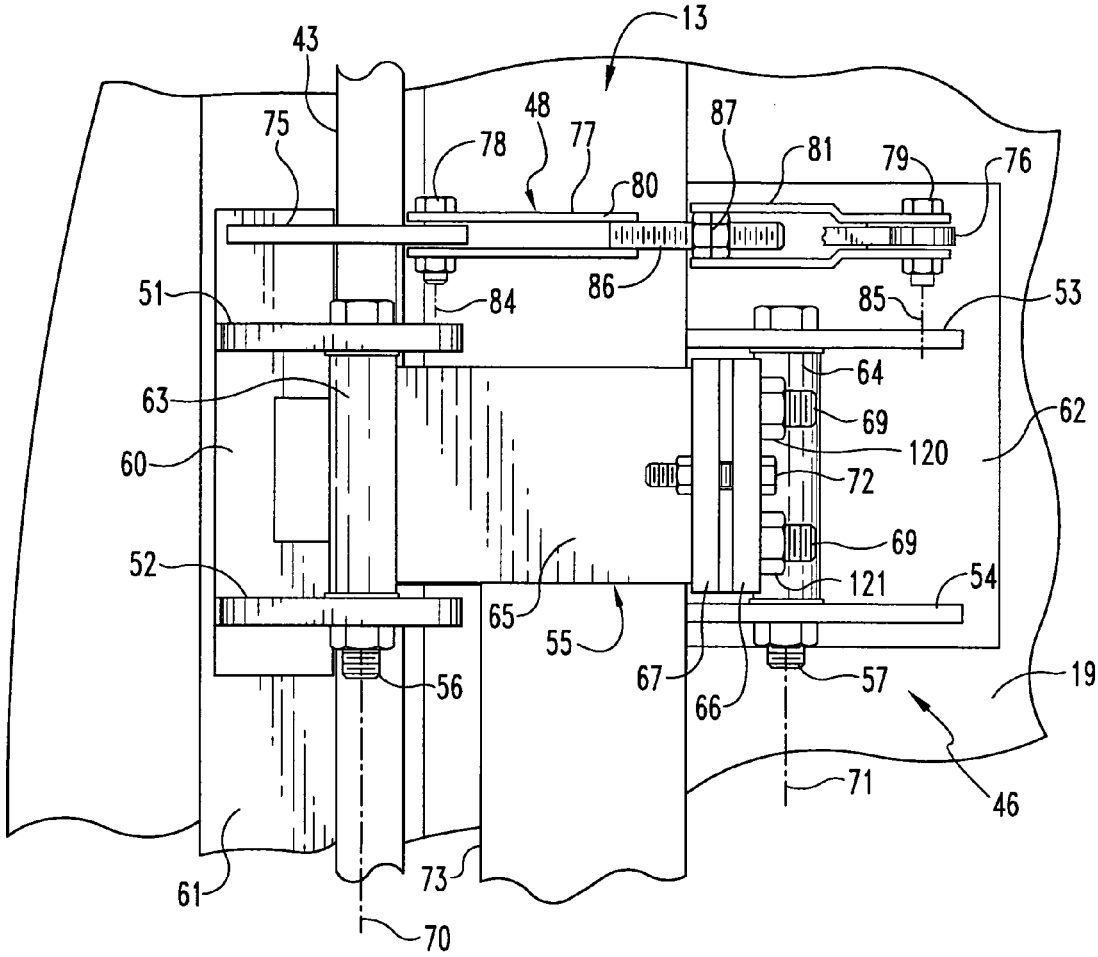
FIG. 3 is a side view of the hinge 46 and control mechanism 48 of hinge assembly 13 of the container 5 of FIG. 2.
Figure 13:
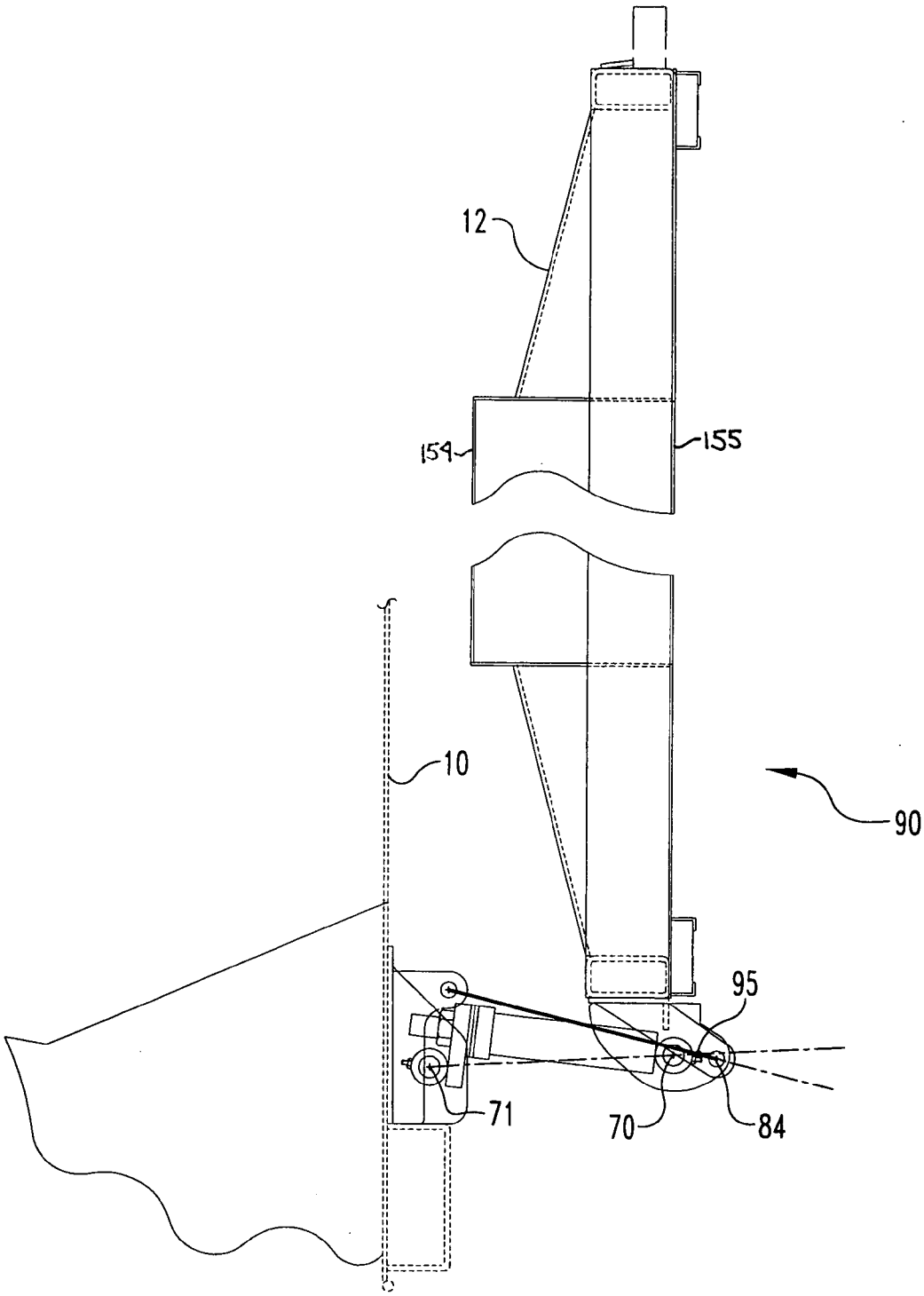
Figure 14:
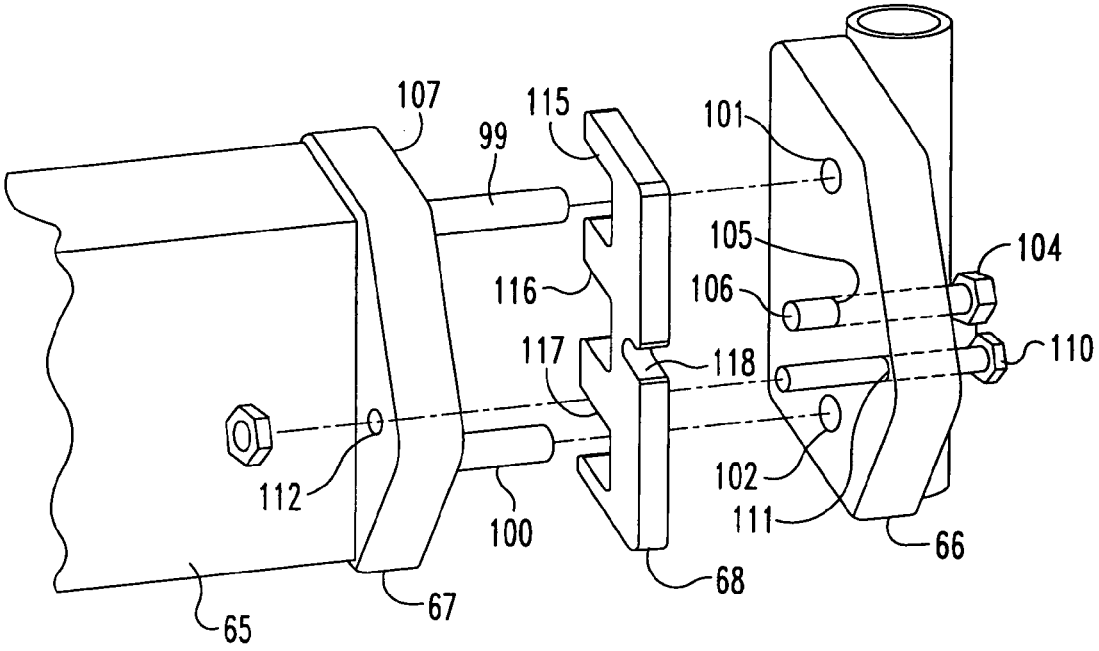
FIG. 14 is a perspective, exploded view of a portion of hinge 46, and particularly showing spacer 68.

Hinge plate 55 includes a first bushing 63, a second bushing 64 and a central plate 65 extending rigidly between bushings 63 and 64. A first mounting block 66 is fixed to second bushing 64, and a mating second mounting block 67 is fixed to central plate 65. A spacer 68 is interposed between blocks 66 and 67 (FIGS. 3 and 14). The thickness of spacer 68 is selected to permit door 12 to be pulled and latched in a closed and sealed position whereby the desired fluid tight seal is created between sealing bead 35 and gasket 44. As gasket 44 (or similar sealing structure) wears, forms an indentation or "set", or otherwise changes so that the seal between gasket 44 and bead 35 is compromised, spacer 68 may be replaced with a spacer of sufficiently smaller thickness to allow door 12 to be pulled sufficiently closer to container body 5. The integrity of the seal between bead 35 and gasket 44 is thereby reinstated. In another embodiment, one or more spacers 68 are disposed between blocks 66 and 67. (FIGS. 2, 3 and 14 show an embodiement with just one spacer 68, and FIGS. 4–13 show an alternative emodiment with two spacers 68.) When it is desired to adjust the door position closer to container body 10 due to wearing or setting of gasket 44, the spacer(s) 68 are completely removed and blocks 66 and 67 are brought tightly together with no spacer therebetween. Upon further wearing of gasket 44, some or all of gasket 44 is replaced, as necessary, and the spacer(s) are inserted back between blocks 66 and 67, as described herein. For convenience, the spacers removed from between blocks 66 and 67 are stored on the outside of first mounting block 66 for ready access when it/they are to be repositioned between blocks 66 and 67.

Hinge plate 55 is pivotally connected to door 12 to rotate about a first rotation axis 70 via first hinge pin 56, which extends through mounting brackets 51 and 52 and first bushing 63. Hinge plate 55 is pivotally connected to container body 12 to rotate about a second rotation axis 71 via second hinge pin 57, which extends though mounting brackets 53 and 54 and second bushing 64. Except for the action of control mechanism 48, door 12 could thus pivot about either of the two parallel axes 70 and 71.

Control over the pivoting action of door 12 relative to container body 10 is provided in the present embodiment by a combination of a single control mechanism 48 and torsion bar 73. Torsion bar 73 is a rigid bar that is fixably secured as by welding between the central plate 65 of hinges 46 and 47 thereby causing the central plates 65 of hinges 46 and 47 to move as a single unit.

Control mechanism 48 includes a third bracket 75, a fourth bracket 76 and a link member 77. Brackets 75 and 76 are rigidly connected to reinforcing plates 60 and 62, respectively, by any appropriate means such as welding. Link member 77 is pivotally connected via pin 78 to third bracket 75 and is pivotally connected via a pin 79 to fourth bracket 76. The length of link member 77 is adjustable, and includes a first clevis 80 and a second clevis 81. First clevis 80 is pivotally connected to rotate relative to third bracket 75 and about a third axis 84 via pin 78, as shown, and second clevis 81 is pivotally connected to rotate relative to fourth bracket 76 and about a fourth axis 85 via pin 79, as shown. A threaded bolt 86 or similar member extends from the outboard end of first clevis 80 and threads into the internally threaded, outboard end 87 of second clevis 81. The present invention contemplates any alternative structures that provide pivotal connection at axes 84 and 85 between brackets 75 and 76, with adjustability (by link member 77, for example) being preferred.

Figure 4:
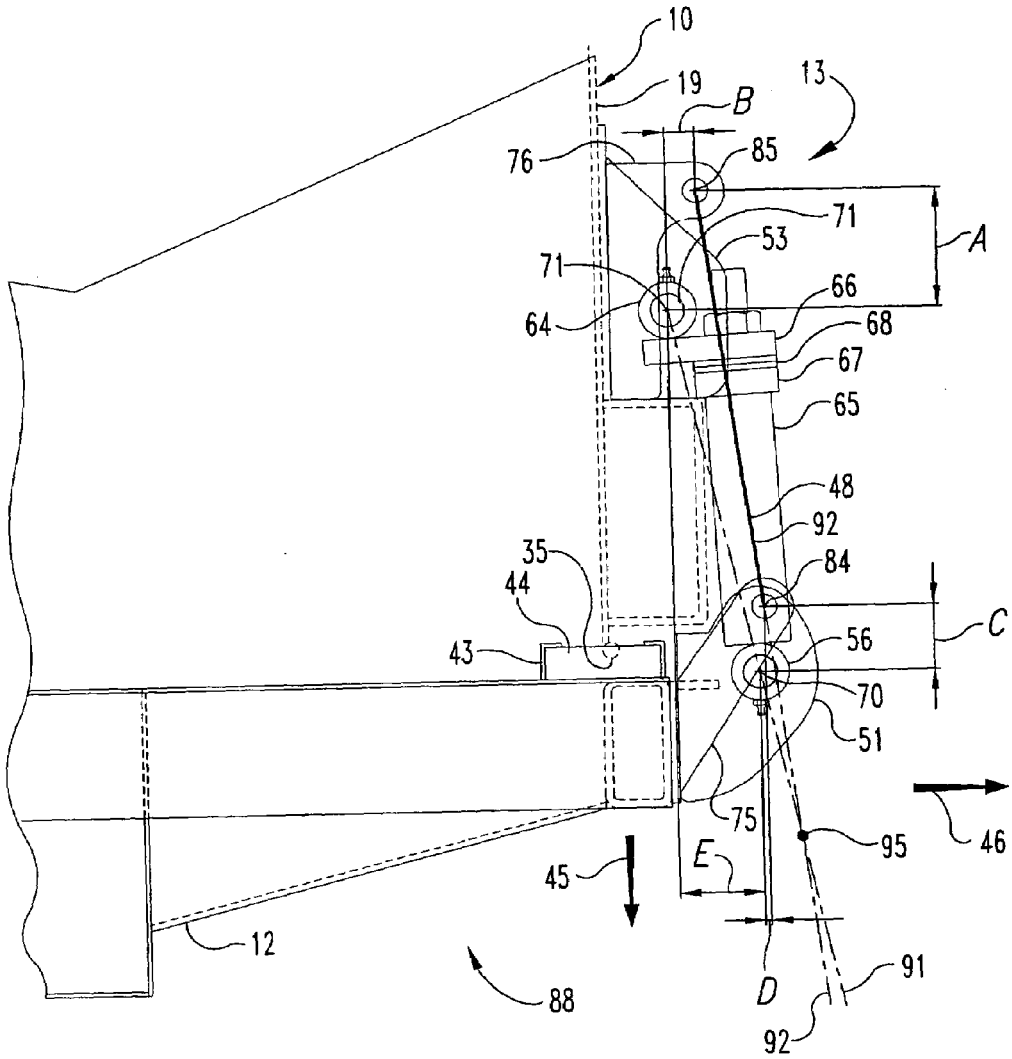
FIG. 4 is a top, cross sectional view of a portion of the container 5 of FIG. 2 taken along the lines of 4—4 and viewed in the direction of the arrows, and with door 12 shown in the closed and sealed position.
Figure 5:
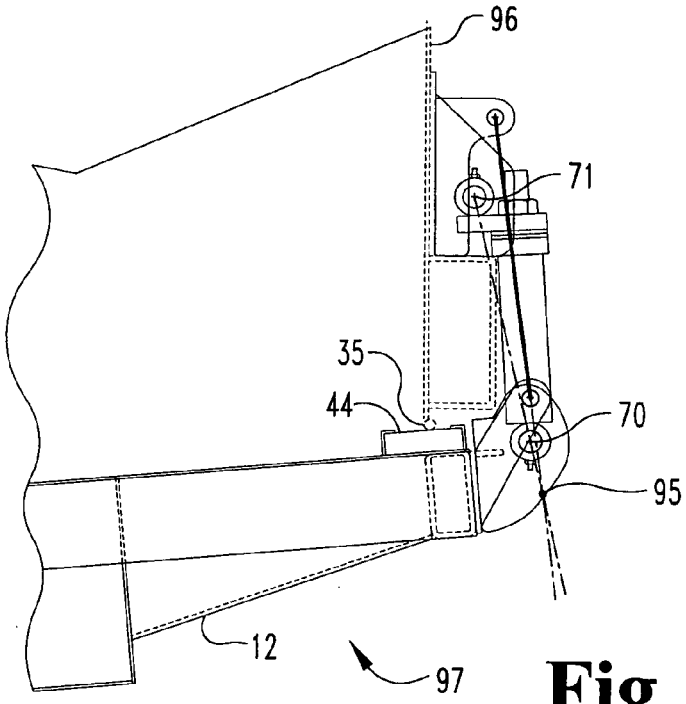
FIGS. 5–13 are top, cross sectional views of the portions of container 5 of FIG. 2, and showing door 12 opened in successively increasing degrees from container body 10.
Figure 6:
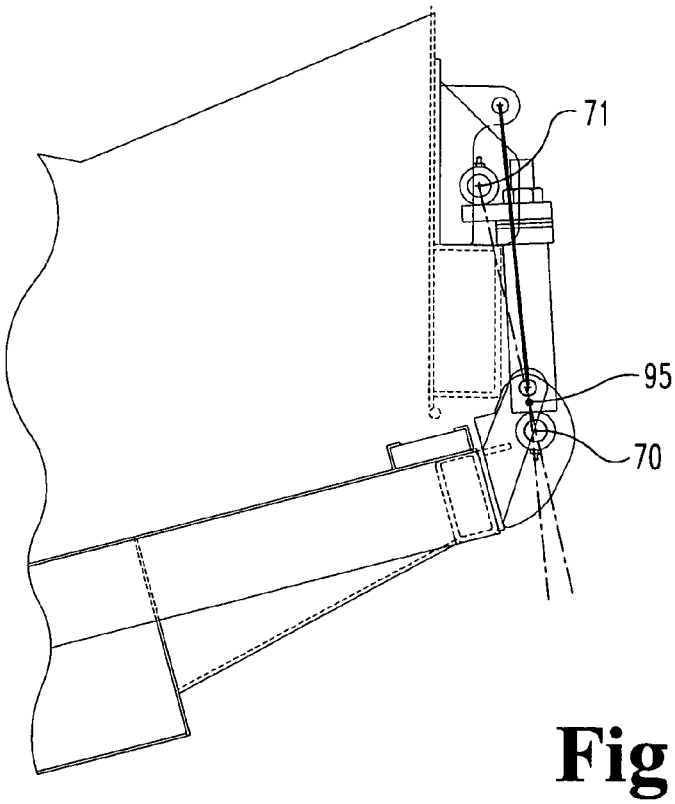
Figure 7:
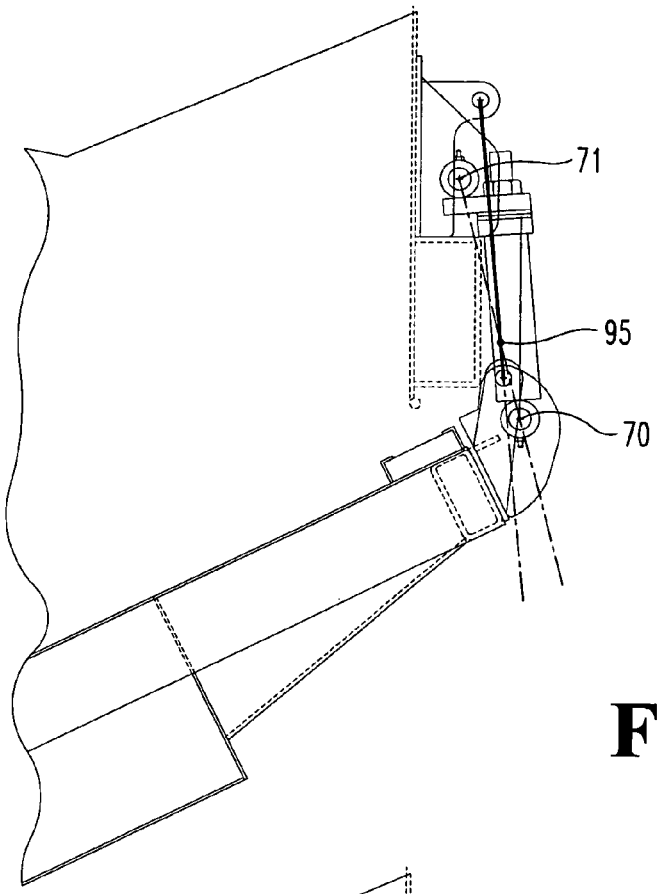
Figure 8:
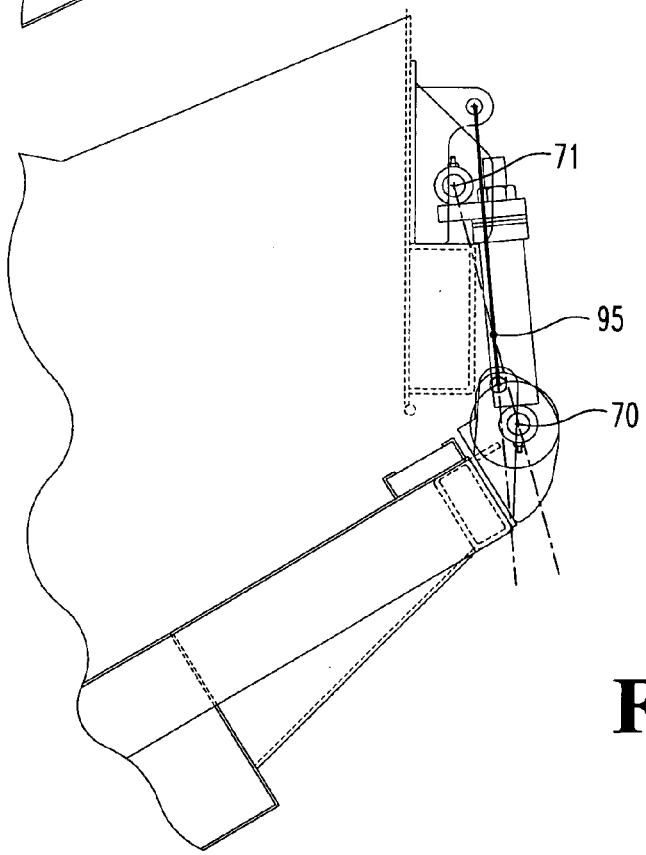
Figure 9:
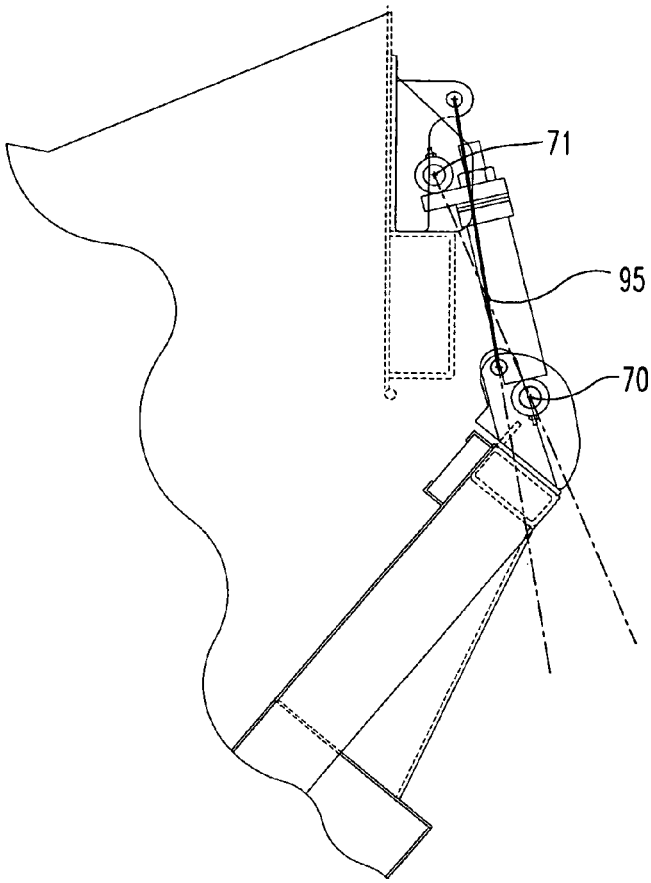
Figure 10:
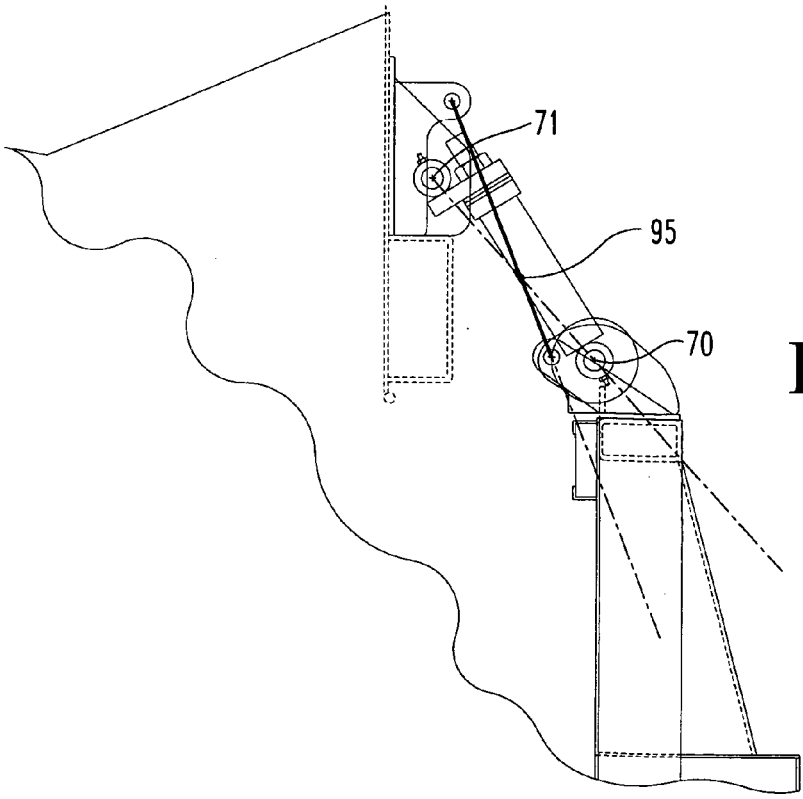
Figure 11:
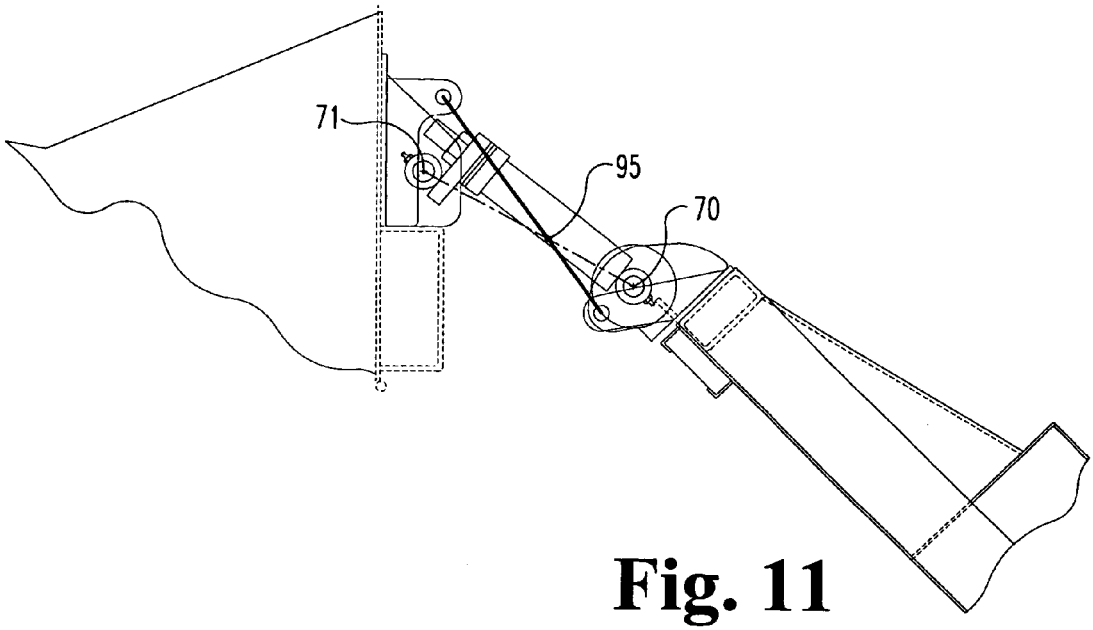
Figure 12:
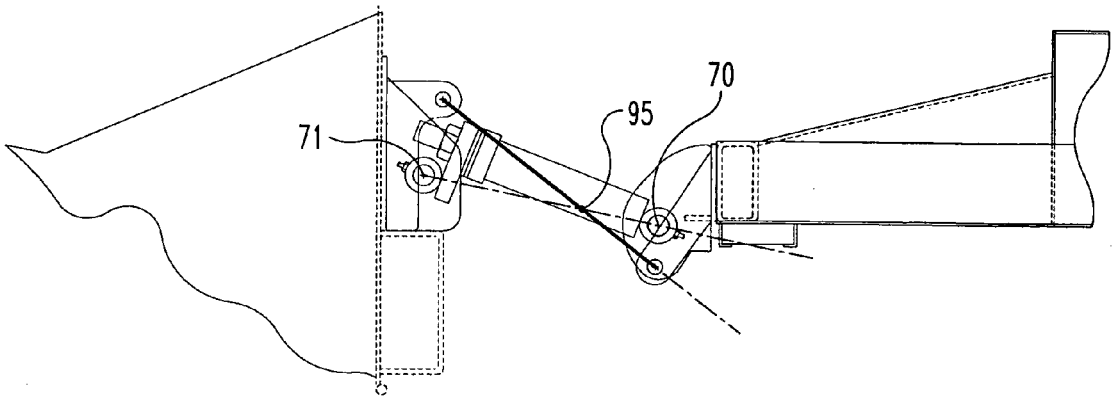

As seen in FIGS. 2–4, with door 12 in the closed and sealed position, door 12 is pulled tightly to container body 10 so that bead 35 is firmly received against gasket 44. As seen in FIGS. 3 and 4, rotation axes 84 and 85 of control mechanism 48 are offset from the rotation axes 70 and 71 of hinge 46 (and of hinge 47, the hinge axes of which coincide with hinge axes 70 and 71). The movement of door 12 is thus defined by the two hinge units (46 and 47), on the one hand, and by control mechanism 48, on the other hand, with mutually parallel, but not coincidental axes of rotation. In FIGS. 4–13, the controlled movement of door 12 is shown from a closed and sealed position 88 (FIG. 4) through a fully open position 90 (FIG. 13) where door 12 is positioned alongside container body 10.

The hinge unit(s) and control mechanism 48 of assembly 13 may be configured with adjustability and with hinge rotation axes 70 and 71 and 84 and 85 in an infinite number of positions to create an infinite number of opening and closing paths of door 12. In the present embodiment and as shown in FIGS. 4–13, hinge assembly 13 is configured to cause door 12 to primarily rotate about the rearward hinge axis 70 first. This serves to reduce the lateral component of movement of gasket 44 relative to sealing bead 35 and thereby lessens the lateral rubbing against and prematurely eroding of the gasket.

As shown in FIG. 4, a door hinge plane 91 is defined by the parallel hinge axes 70 and 71, both of which lie in plane 91. A control hinge plane 92 is defined by the parallel rotation axes 84 and 85, both of which lie in plane 92. (For discussion purposes in FIGS. 4–13, control mechanism 48 is shown graphically by a line extending from third and fourth axes 84 and 85. The line representing control mechanism 48 therefor corresponds directly with control hinge plane 92). In the closed and sealed position 88 (FIG. 4), fourth axis 85 is juxtaposed forwardly a distance A of and outwardly a distance B of second axis 71 relative to container body 10, and third axis 84 is juxtaposed forwardly a distance C and outwardly a distance D of first axis 70 relative to container body 10, and door 12 is constructed and is mounted to container body 10 such that first axis 70 is juxtaposed outwardly a distance E of second axis 71. In the present embodiment A>C and B>D and E>B, and door hinge plane 91 intersects control hinge plane 92 at line 95, and line 95 is located rearwardly of first axis 70. As door 12 opens and gasket 44, at the hinge side 96 of container body 10, moves from an in-contact position in contact with bead 35 (FIG. 5) to a not in-contact position away from bead 35 (FIG. 6), plane intersection line 95 moves from a position rearwardly of first axis 70 (FIG. 5) to a position forwardly of axis 71 and between door hinge axes 70 and 71. As door 12 is moved further from the slightly ajar position 97 (FIG. 5) toward the fully open position 90 (FIG. 13), plane intersection line 95 stays between door hinge axes 70 and 71, and first axis 70 and control hinge axis 84 revolve around each other until door 12 is in the fully open position 90 (FIG. 13). In the fully open position 90, first axis 70 is again closer to the other door hinge axis 71 than is control hinge axis 84, and plane intersection line 95 is again outside of (not between) door hinge axes 70 and 71.

In the embodiment shown in FIGS. 4–13, the straight line distance between first axis 70 and fourth axis 85 is less than the sum of the distances between first axis 70 and third axis 84 and between third axis 84 and fourth axis 85. This means that when door 12 is initially swung open, axis 70 moves farther away from fourth axis 85 until, as shown if FIG. 4, third axis 84 passes from right to left and axes 70 and 84 begin to revolve counterclockwise around each other. Thus upon the initial opening, gasket 84 actually moves straight rearwardly away from bead 35. This initial rearward may be modified as desired by altering the relative distances A–E of hinge assembly 13.

The present invention includes one or more first hinges (like hinge 46) with first and second spaced apart axes (like axes 70 and 71) and one or more second hinges (like control mechanism 48) with third and fourth spaced apart axes (like axes 84 and 85), where the first, second, third and fourth axes are parallel but separate, and where the position of the first, second, third and fourth axes form a parallelogram (such as defined by the points 70, 71, 84 and 85 in FIG. 4).

Referring to FIGS. 3 and 14, a pair of bolts 99 and 100 extend from second mounting block 67 and are received through a pair of aligned holes 101 and 102 in first mounting block 66. A bolt 104 is threadedly received through a hole 105 in first mounting block 66 roughly midway between holes 101 and 102. The left end 106 of bolt 104 is intended to bear against the right hand surface 107 of second mounting block 67. A spacer retention bolt 110 extends through a hole 111 in first mounting block 66 and through an aligned hole 112 in second mounting block 67. Spacer 68 defines three inboard cutouts 115, 116 and 117 and one outboard cutout 118, generally as shown in FIG. 14. In assembly, spacer 68 is interposed between first and second blocks 66 and 67 with bolts 99 and 100 passing through cutouts 115 and 117 and through holes 101 and 102. Nuts 120 and 121 are received on the outboard ends of bolts 99 and 100 to tightly secure blocks 66 and 67 together on opposing sides of spacer 68, as shown in FIG. 3. Clearance for retention bolt 110 is provided through cutout 118 and clearance for bolt 104 is provided through cutout 116.

When it is desired to replace spacer 68 with a spacer of a different size, nuts 120 and 121 are loosened and retention bolt 110 is removed. Bolt 104 is advanced toward second mounting block 67 so that left end 106 bears against right hand surface 107 and forcibly separates mounting blocks 66 and 67. As the gap between mounting blocks 66 and 67 widens, spacer 68 may easily be removed and a replacement spacer may be inserted. Retention bolt 110 is loosely replaced to hold the new spacer 68 in place. Bolt 104 is then withdrawn to allow nuts 120 and 121 to be tightened to clamp the new spacer 68 in place. Retention bolt 110 may then be tightened.

Figure 15:
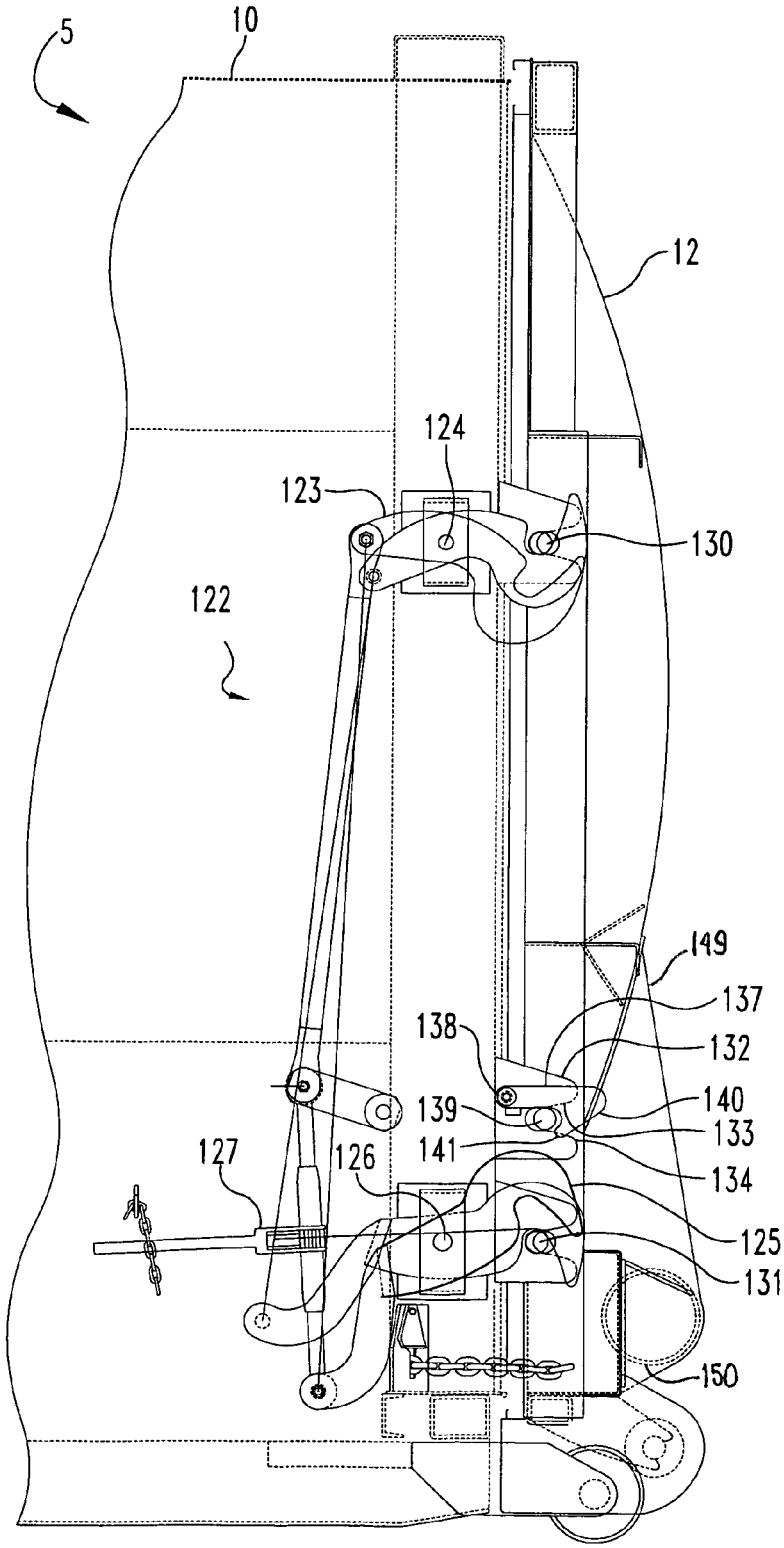
FIG. 15 is a side, elevational view of the rear left side of container 5 and showing latching assembly 122.

Referring to FIG. 15, the rear left side of the container is provided with a door latching assembly 122 as is common among such containers. The lacking assembly 122 is shown in both its latched and unlatched positions and generally includes an upper hook 123 pivotally mounted to the side of the container body 10 by a pin 124 and includes a lower hook 125 pivotally connected to the side of container body 10 by a pin 126. A ratchet mechanism 127 is interconnected at the forward ends of each hook 123 and 125 by appropriate linkages that, upon actuation of ratchet mechanism 127, causes hooks 123 and 125 to pivot correspondingly about their pins 124 and 126 to thereby either engage with or disengage with corresponding locking pins 130 and 131 to either pull door 12 tightly in sealing engagement against container body 10 or to release door 12 from such sealing engagement.

Extending rearwardly from container body 10 is a generally C-shaped alignment cang 132 with upper and lower forwardly converging surfaces 133 and 134. A latching hook 137 is pivotally connected to container body 10 at a pin 138. When door 12 is initially swung to a closed position, a pin 139, extending outwardly from door 12, engages sloping surface 140 of holding hook 137 and pivots it about its pivot pin 138 up and out of the way as pin 139 enters the slot of alignment cang 132. The forwardly converging alignment surfaces 133 and 134 engage with door pin 139 to force door 12 into the proper vertical alignment for sealing and latching. Once pin 139 has substantially entered the slot of alignment cang 132 and cleared the lower hook point 141, holding hook 137 drops back by gravity and closes off the slot of alignment cang 132, thereby holding pin 139 and door 12 in place. Ratchet mechanism 127 may then be operated to pull door 12 into sealing engagement with container body 12.

Referring to FIG. 2, there is shown a C-shaped door support fixture fixedly secured by any appropriate means such as welding to the side 19 of container body 10, slightly above lower hinge 47. Fixture 144 defines a rearwardly opening slot 145. A support post 146 is fixedly secured by any appropriate means such as welding to the side edge 61 of door 12. Post 146 is positioned on side edge 61 so that, as door 12 is closed, it enters slot 145 and resides in slot 145 when door 12 is in the closed and sealed position, as shown in FIG. 4. Door 12 also includes a pair of rearwardly extending bracket (one shown) and a lift bar 150 held fixedly therebetween.

In certain instances, container 5 is positioned for use up against a building or loading dock. Lift bar 150 and door support mechanism 143 are provided to enable container 5 to be pulled away from the building so that it may then be properly loaded onto a hoist. In use, the hoist vehicle backs up against the rear end of container 5 and a hook on the hoist is positioned below and around lift bar 150. Container 5 is then lifted vertically from the ground and pulled away from the building to the desired position. Support post 146 is lodged firmly within slot 145 so that, when container 5 is lifted at lift bar 150, the lift force between door 12 and container body 10 of container 5 is borne in substantial degree by door support mechanism 143 and by cang 132 and pin 139, and hinges 46 and 47 and control mechanism 48 are thereby lessened of such lifting load. It is noted that door 12 has a thickness, generally between the outside side 154 and the inside side 155 (plus the thickness of sealing channel 43). The present invention permits door 12 to be swung 270 degrees from the closed and sealed position 88 to the fully open position 90 alongside the side of container body 10, as shown in FIG. 13. Door 12 may then be temporarily secured to container body 10 and the container, as loaded on a companion hoist, can be tilted to a steep angle—as much as about 48 degrees—for dumping. The door 12 is thus safely secured to the side of container body 10.

Door 12 is designed to completely close off opening 11. However, alternative embodiments are contemplated wherein door 12 does not completely close off its corresponding opening, but leaves a portion uncovered, for example, at the top of the door or through a portal that may be closable with its own door.

Alternative embodiments are contemplated wherein hinge assembly 13 could comprise two or more control mechanisms 48 spaced or positioned strategically along the side 61 of door 12 or by a single control mechanism 48 that is larger, stronger and/or has more connection points to door 12 and/or container body 10, all in order to provide control over the pivot action of door 12 that would be inherently lacking from the two axes 70 and 71 of two or more hinges such as 46 and 47.

While the invention has been illustrated and described in detail in the drawings and foregoing description, the same is to be considered as illustrated and not restrictive in character, it being understood that only the preferred embodiment has been shown and described and that all changes and modifications that come within the spirit of the invention are desired to be protected.

What is claimed is:

1. A waste container comprising:

a container body defining at least one opening;

a door sized and configured to close off said at least one opening;

a seal connected with one of said container body and said door;

a hinge assembly connected between said container body and said door to permit said door to swing between a closed position covering said opening and an open position uncovering said opening, said hinge assembly including at least one hinge unit and at least one control mechanism, said at least one hinge unit having at least first and second door rotation axes and said at least one control mechanism being mechanically connected to and between said container body and said door to control the degree of rotation of said door about said at least first and second door rotation axes;

wherein said seal is juxtaposed relative to said container body and said door to provide a fluid tight seal between said container body and said door when said door is in a closed and sealed position;

a latching assembly mechanically connected between said container body and said door to hold said door in the closed and sealed position;

wherein said at least one hinge unit includes a first bushing mounted to said door and a second bushing mounted to said container body and a hinge plate pivotally mounted to both said first and second bushings, at least one replaceable spacer interposed between said container body and said door to provide for adjusting the distance between said door and said container body in the closed and sealed position, and means for replaceably holding the at least one replaceable spacer; and;

wherein said hinge plate is pivotally mounted to both said first and second bushings to pivot about both said first and second door rotation axes, and wherein said at least one hinge unit includes at least one holding member extending from one of the hinge plate and the second bushing for holding the spacer in position relative to said hinge plate and second bushing.

2. The waste container of claim 1 wherein said at least one hinge unit includes at least one separating member extending from one of the hinge plate and the second bushing for forcibly separating the hinge plate and the second bushing to allow for replacement of the spacer.

3. A waste container, comprising:

a container body defining at least one opening;

a door sized and configured to close off said at least one opening;

a seal connected with one of said container body and said door;

a hinge assembly connected between said container body and said door to permit said door to swing between a closed position covering said opening and an open position uncovering said opening, said hinge assembly including at least one hinge unit and at least one control mechanism, said at least one hinge unit having at least first and second door rotation axes and said at least one control mechanism being mechanically connected to and between said container body and said door to control the degree of rotation of said door about said at least first and second door rotation axes;

wherein said seal is juxtaposed relative to said container body and said door to provide a fluid tight seal between said container body and said door when said door is in a closed and sealed position;

a latching assembly mechanically connected between said container body and said door to hold said door in the closed and sealed position;

wherein said at least one hinge unit includes a first bushing mounted to said door and a second bushing mounted to said container body and a hinge plate pivotally mounted to both said first and second bushings, at least one replaceable spacer interposed between said container body and said door to provide for adjusting the distance between said door and said container body in the closed and sealed position, and means for replaceable holding the at least one replaceable spacer; and;

wherein said at least one hinge unit includes a first mounting block connected to one end of the hinge plate, includes a second mounting block connected to the second bushing, and includes at least one holding member extending from one of the first and second mounting blocks for holding the spacer in position relative to the first and second mounting blocks.

4. The waste container of claim 3 wherein said at least one hinge unit includes at least one separating member for forcibly separating the first and second blocks to allow for replacement of the spacer.

5. The waste container of claim 4 wherein the at least one separating member includes a bolt extending from one of the first and second blocks and is sized and configured to bear against the other of the first and second blocks.

6. A waste container, comprising:

a container body defining at least one opening;

a door sized and configured to close off said at least one opening;

a seal connected with one of said container body and said door;

a hinge assembly connected between said container body and said door to permit said door to swing between a closed position covering said opening and an open position uncovering said opening, said hinge assembly including at least one hinge unit and at least one control mechanism, said at least one hinge unit having at least first and second door rotation axes and said at least one control mechanism being mechanically connected to and between said container body and said door to control the degree of rotation of said door about said at least first and second door rotation axes;

wherein said seal is juxtaposed relative to said container body and said door to provide a fluid tight seal between said container body and said door when said door is in a closed and sealed position;

a latching assembly mechanically connected between said container body and said door to hold said door in the closed and sealed position;

wherein said at least one hinge unit includes a first bushing mounted to said door and a second bushing mounted to said container body and a hinge plate pivotally mounted to both said first and second bushings; and;

wherein said at least one hinge unit includes first and second hinges, the first and second door rotation axes of the first hinge coinciding with the first and second door rotation axes of the second hinge, and wherein said at least one hinge unit further includes a torsion bar rigidly connected between the hinge plates of the first and second hinges.

7. The waste container of claim 6 wherein the control mechanism includes a link pivotally connected at a first end to said door to rotate about a third control axis and pivotally connected at a second end to said container body to rotate about a fourth control axis.

8. The waste container of claim 7 wherein the third and fourth axes are offset from the first and second axes.

9. The waste container of claim 8 wherein in the closed position, the fourth axis is juxtaposed forwardly a distance A of and outwardly a distance B of the second axis relative to said container body, and the third axis is juxtaposed forwardly a distance C and outwardly a distance D of the first axis relative to said container body, and the first axis is juxtaposed outwardly a distance E of the second axis relative to said container body.

10. The waste container of claim 9 wherein A>C.

11. The waste container of claim 9 wherein B>D.

12. The waste container of claim 9 wherein E>B.

13. The waste container of claim 8 wherein the link has a length that is adjustable to adjust the distance between the third and fourth axes.

* * * * *